US007785668B2

(12) United States Patent
Damrau

(10) Patent No.: US 7,785,668 B2
(45) Date of Patent: Aug. 31, 2010

(54) DOCTOR METHOD

(76) Inventor: Wayne A. Damrau, 6540 Wazeecha Ridge Ct., Wisconsin Rapids, WI (US) 54494

( * ) Notice: Subject to any disclaimer, the term of this patent is extended or adjusted under 35 U.S.C. 154(b) by 920 days.

(21) Appl. No.: 10/537,241

(22) PCT Filed: Dec. 5, 2003

(86) PCT No.: PCT/US03/38695

§ 371 (c)(1),
(2), (4) Date: Nov. 22, 2006

(87) PCT Pub. No.: WO2004/052554

PCT Pub. Date: Jun. 24, 2004

(65) Prior Publication Data

US 2007/0104873 A1 May 10, 2007

Related U.S. Application Data

(60) Provisional application No. 60/431,270, filed on Dec. 6, 2002.

(51) Int. Cl.
*B05D 1/28* (2006.01)
*B05C 1/04* (2006.01)
*B05C 1/08* (2006.01)

(52) U.S. Cl. ..... 427/359; 118/118; 118/119; 118/122; 118/126; 118/203; 118/413; 118/420; 427/356

(58) Field of Classification Search ..... 427/359
See application file for complete search history.

(56) References Cited

U.S. PATENT DOCUMENTS

| | | | | |
|---|---|---|---|---|
| 4,250,211 | A | | 2/1981 | Damrau et al. |
| 4,316,428 | A | * | 2/1982 | Flaum et al. ..... 118/203 |
| 5,749,972 | A | | 5/1998 | Bernert et al. |
| 5,958,513 | A | | 9/1999 | Madrzak |
| 6,159,289 | A | | 12/2000 | Kurtz et al. |

FOREIGN PATENT DOCUMENTS

| | | | |
|---|---|---|---|
| DE | 19631913 | | 2/1998 |
| DE | 19631913 | A1 * | 2/1998 |

* cited by examiner

*Primary Examiner*—Michael Kornakov
*Assistant Examiner*—Alexander Weddle
(74) *Attorney, Agent, or Firm*—Pyle & Piontek, LLC

(57) ABSTRACT

A doctor method and apparatus is disclosed and includes a doctor roll (12) supported in a coater (1) suitable for applying coating to a paper web surface or a roll surface (4) for subsequent transfer to the paper web. The doctor includes a doctor roll (12), a support (11) for the doctor roll (12), a front support (3) for holding the roll support (11) and a rear support or retainer (18) cooperates with and helps stabilize the support (11) and doctor roll (12). The present invention minimizes the variation moving of the doctor roll (12) has on the coating on the moving surface (4), be it web or roll, and thus can improve coating quality.

15 Claims, 3 Drawing Sheets

DOCTOR METHOD

This United States PCT application is a continuation-in-part of U.S. Provisional Patent Application Ser. No. 60/431,270, filed Dec. 6, 2002, of the same title and by the same inventor on which a claim of priority and benefit of filing date is made. This invention relates to a type of doctor for a coating apparatus and method for coating a traveling web material, such as paper, or for coating the surface of a roll and then transferring said coating to a traveling web in a pressure nip form by another roll, blade or other pressure applying device.

BACKGROUND OF THE INVENTION

It is known to use a doctor roll in a coater such as a short dwell time applicator ("SDTA") or a film coater as shown in U.S. Pat. Nos. 4,250,211 and 5,749,972, these patents being incorporated herein by reference, in conjunction with a backing roll to meter coating applied to a moving paper web or first to a roll surface and then onto a moving web of paper. These doctor rolls are difficult to locate or hold in a coater as space is restricted. Heretofore, when the doctor roll was loaded into the web or roll surface being coated, the doctor roll was moved toward or away from the web or roll surface to increase or decrease the loading, respectively. Generally, the doctor roll also tended to move downstream in the direction of the web or roll surface travel. This latter movement was somewhat inconsistent, and consequently variation and/or inconsistency in the coating lay and metering by the doctor roll could occur.

SUMMARY OF THE INVENTION

The disadvantages of the prior art are overcome by the method and apparatus of the present invention which provides a method and means for supporting the doctor roll to minimize any movement or travel of the doctor roll in a direction of that of the moving surface of the web or roll and minimizes the inconsistency of coating applied to the surface of the web or roll. To accomplish this, the roll is supported in a roll carrier or support which is permitted to move or generally pivot on a support rod, generally being used as the motion may be somewhat greater than a true pivot connection. The support rod itself may form and close off part of the coater application chamber. To support the doctor roll, a rear or downstream (relative to the direction of web or roll surface movement or travel) support for the doctor roll is provided. To accommodate movement of the roll due to loading by a conventional means (such as a load tube), relative contact surfaces between the roll carrier and roll rear support may be curved or radiused to permit the roll carrier or support and roll therein to move, slide or pivot more freely. Preferably, the rear roll support can be in the form of a releasable element or blade, while the curved or radiused surface may be formed on the rear of the roll carrier or support. Thus, the pivoting of the roll support and moving along the radius provides a more consistent environment for the doctor roll, and therefore lay of coating and/or doctoring of coating on the moving web or roll surface, and consequently more consistently coated paper web.

DESCRIPTION OF THE PREFERRED EMBODIMENT

Figure 1:
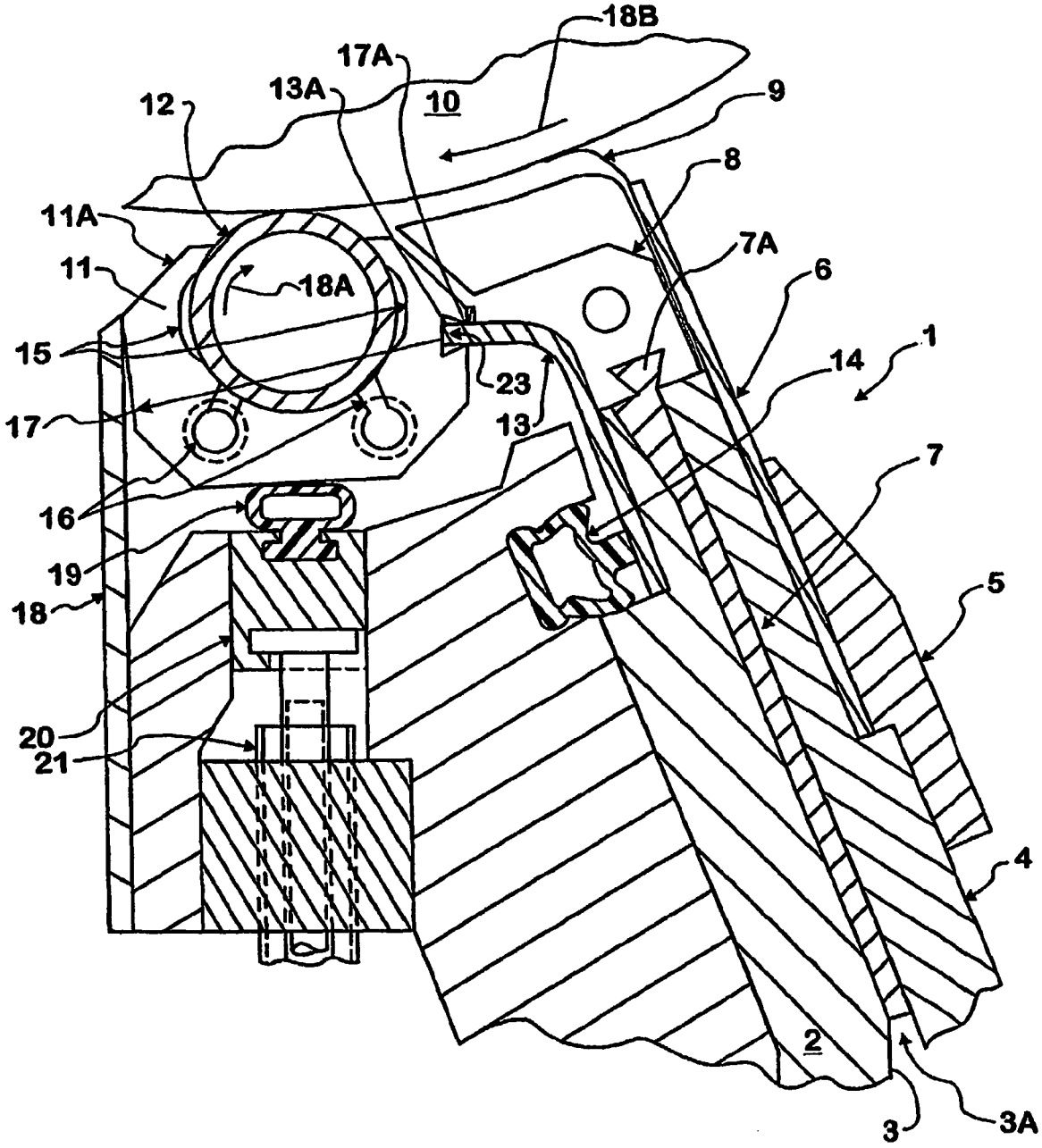
FIG. 1 is a schematic, full scale as filed, cross sectional elevational view of a doctor assembly of the present invention.

Referring to FIG. 1, the coater device is given reference numeral 1. Also part of the coater is body 2 which forms part of the coating chamber 3 and also forms one wall of the coating inlet 3A. The movable wall of the coating chamber as well as the outer wall of the coating chamber is formed by members 4 and 5. Member 5 can be designed to include a clamp tube (not shown but similar to 14 described below) to secure the orifice plate member 6.

An internal coating inlet seal 7 seals the ends of the coating inlet outside of the web run and under the edge dams 8 and 9. There is a metal support for the felt edge dam 9. This assembly seals the ends of the applicator between the orifice plate 7, roll 10 and doctor assembly 11. The edge dam assembly can be adjusted laterally on the dovetail or groove 7A on seal 7.

The doctor assembly 11A comprises the carrier, bed or support 11 for the doctor roll or bar 12. The bed or carrier 11 is made of UHMW polyethylene or similar material. The doctor roll or device 12 can be a solid bar (FIG. 3) or a hollow tube (FIG. 1 or 2), with or without grooves on its outer surface. If solid, the doctor device is consequently generally of a smaller diameter than a hollow rod type doctor roll. Either type of doctor roll may be driven to rotate in a direction, usually, opposite the direction of the moving surface travel, be it a web or roll surface. The doctor's diameter can range from ⅜" to 1½". If a hollow tube is used for the doctor device 12, it can be of sweated construction with cold water flowing through its center. A curved bar 13 supports the front of the support 11. The curved bar 13 is clamped to the main coater by an air pressurized clamp tube 14. The upper surface of the curved bar 13, as shown in FIG. 1, forms a side of the application zone and seals against the edge dam assembly. Reliefs or cutouts 15 are provided in the support 11 for the doctor bar 12. These reliefs allow the bar 12 to rotate more easily. Lateral grooves 16 with the pipe taps or other type connections are provided in either end of the support bed 11. Water is provided to these connections and circulated through these grooves or channels 16 to clean and lubricate the doctor bar or roll 12. A convex radius 17 is provided on the support or bed 11 swung from a pivot point (pivot axis) 17A on its wall. A support plate 18 supports the rear of the support bed 11 of the doctor assembly so that it is contained and not allowed to be moved by the friction against the travel of the web or surface being doctored. Alternatively, the support plate could be provided with a concave contact surface of the support.

When the doctor roll is driven (as indicated by the small arrow 18A) in a direction opposite backing roll rotation (as indicated by the large arrow 18B), it has a tendency to lift the roll up at the rear when not in contact with the backing roll. In order to counteract this tendency, associated means both on the doctor roll support 11 and the rear support plate 18 can be provided. For example, the rear support plate or retainer 18 may have an upper hooked end 118 which engages in a retaining groove 118B in the doctor support 11 (see FIGS. 2 and 3). This arrangement acts as a baffle to prevent coating from egressing towards the loading tube 119. A doctor load tube 19 (somewhat similar to tube 14 in construction) is provided. It is pressurized with air or other fluid to increase the force of the doctor device against the traveling surface or web being doctored. A flexible profile bar 20 supports the load tube 19. This bar can be profiled (adjusted in its cross machine direction) to give the desired doctor force by adjusting the differential screws thread profile screws 21. There is a plurality of the screws 21 spaced 3 to 4 inches apart laterally across the coater assembly. The doctor support 11, on the enlarged shaped 13A end of the curved bar 13, allows the doctor assembly to pivot on the extended tip of the curved bar 13 when the loading by the load tube 19 is changed. The pivot point 17A shown at dovetail groove 23 retains the support 11 to the complementary shaped end or tip 13A of the curved bar 13. This connection allows movement and also seals the pivot. It should be understood there are other generally pivot type connection options, such as a rod and socket assembly, or other means that could be used.

Figure 2:
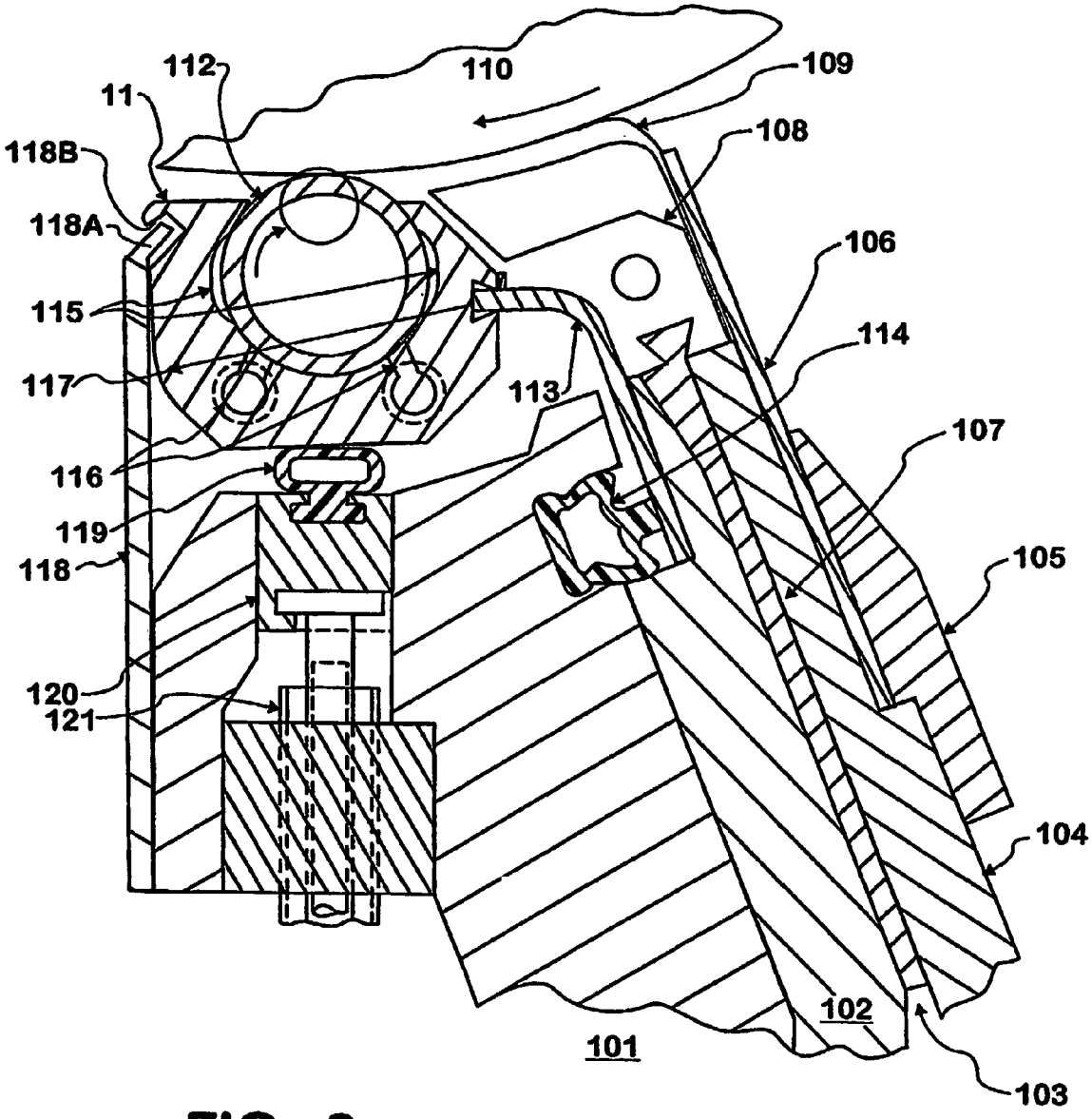
FIG. 2 is a full scale as filed, view similar to FIG. 1 but of a second embodiment.

FIG. 2 is similar to FIG. 1, except it shows the hooked plate or retainer 118 which can engage with the groove 118B on the support 11 to limit lift of the doctor. As the coaters shown in FIGS. 1 and 2 are generally similar except for this difference, similar reference numerals are used in FIG. 2, except the number is 100 higher. For example, 4 of FIG. 1 is shown as 104 in FIG. 2.

Figure 3:
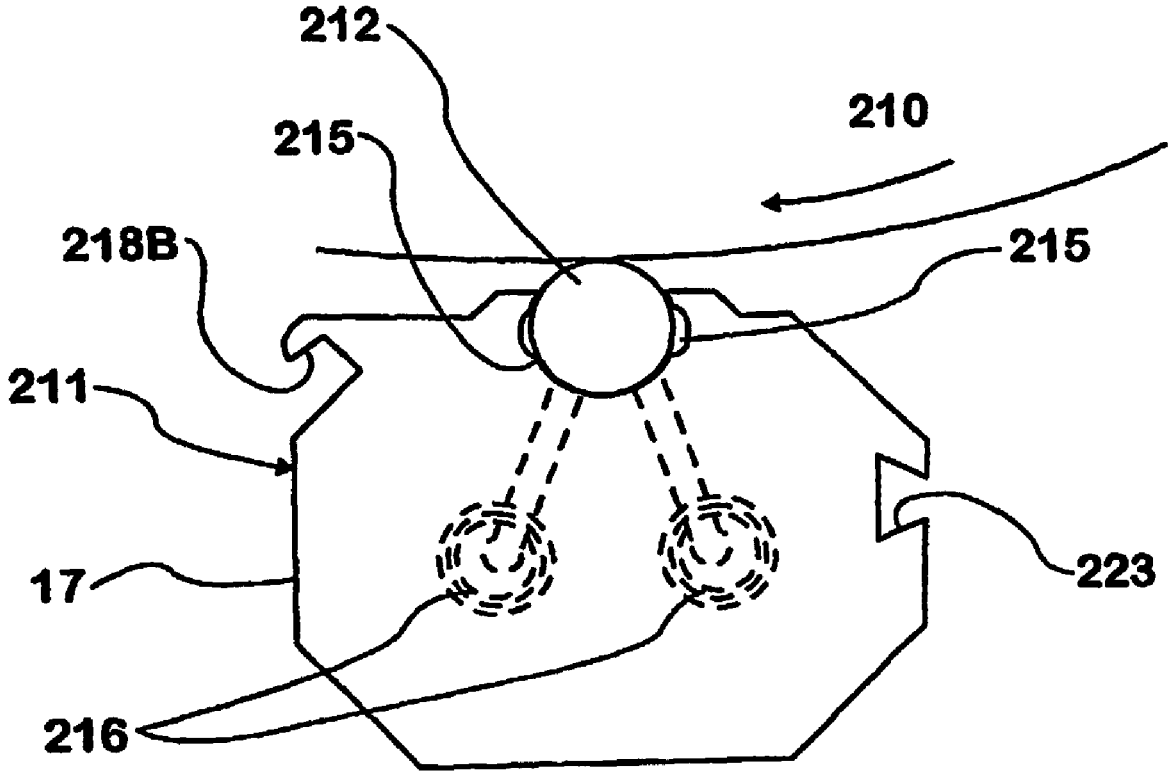
FIG. 3 is a partial view similar to FIGS. 1 and 2, but showing a roll carrier or support for a solid doctor roll.

FIG. 3 is similar to FIGS. 1 and 2, but only shows the solid doctor rod 212 and its support 211. Note that the doctor rod 212 and its complementary groove receiving the rod are smaller in diameter than for a hollow doctor roll. Again, except for these differences, the rod and support of FIG. 3 is similar to those of FIGS. 1 and 2, and reference numerals are also similar, except given numbers 200 higher, that is, 23 in FIG. 1 or 123 in FIG. 2, becomes 223 in FIG. 3.

It should be understood that the doctor support of the present invention that can be used with any doctor be it generally integral in a coater, such as a short dwell time applicator type, or in a stand alone doctor roll, such as in a dip roll, separate doctor. It should also be understood that the doctor roll could have a plain smooth surface roll or a grooved roll. It should be further understood that the invention could be used when coating a paper or board web either directly or indirectly via a transfer roll. While specific elements and steps have been described, it should be understood that equivalent elements and steps will fall within the scope of the following claims.

What is claimed is:

1. A method for doctoring a coating excess applied by a coater to a moving surface with a doctor roll, comprising the steps of:

(1) applying excess coating to the moving surface, (2) rotating a doctor roll in a doctor roll support having upstream and downstream ends adjacent the moving surface and the excess coating thereon, (3) moving the doctor roll support and doctor roll toward or away from the moving surface for controlling the amount of excess coating removed from the moving surface by the doctor roll, (4) limiting the movement of the doctor roll and the doctor roll support in the direction the moving surface is moving, the step of limiting movement of the doctor roll support comprising generally pivoting the upstream end of the doctor roll support about an axis upstream of the doctor roll, (5) retaining the downstream end of the doctor roll support against a downstream retaining member, (6) sliding the downstream end of the doctor roll support against the retaining member, (7) loading the doctor roll against the moving surface for establishing the force of the doctor roll toward the moving surface, and (8) doctoring the excess coating off the moving surface with the doctor roll, whereby the coating on the moving surface is consistently doctored by said doctor roll.

2. A method for doctoring as in claim 1, further comprising the step of supplying coating to and removing the excess coating from a paper or board web, whereby the coating on the paper or board web is consistently doctored by said doctor roll.

3. A method for doctoring as in claim 1, further comprising the steps of applying a coating excess by a coater to a moving roll surface of a roll, removing excess coating from the roll surface with the doctor roll, then transferring coating from the roll surface to a paper/board web, whereby the coating on the moving roll surface is consistently doctored by said doctor roll and then transferred to the paper/board web.

4. A method as in claim 1, further including the step of pivoting the doctor roll and doctor roll support about the pivoting axis in the coater integral with the doctor roll.

5. A method as in claim 1, further including the step of pivoting the doctor roll and doctor roll support about the pivoting axis downstream of the coater, which may be separate from the doctor roll.

6. A method as in claim 1, further including the step of pivoting the doctor roll support on a curved bar upstream of the doctor roll.

7. A method as in claim 6, further including the steps of pivoting the doctor roll support off the curved bar upstream of the doctor roll and in the coater which is integral with the doctor roll, and at least particularly sealing the excess coating in the integral coater with the curved bar.

8. A method as in claim 6, further comprising the step of pivoting the doctor roll off of the downstream end of the curved bar.

9. A method as in claim 6, further including the step of applying the excess coating to the moving surface upstream of the doctor roll and doctor roll support and closely adjacent the curved bar.

10. A method as in claim 1, further including the further step of cooling the doctor roll support.

11. A method as in claim 1, further including the steps of curving the downstream end of the doctor roll support and pivoting and sliding the curved downstream end of the doctor roll support against the retaining member.

12. A method as in claim 1, further including the step of rotating the doctor roll in a direction so that at the point of contact with coating on the moving surface the doctor roll moves in the opposite direction of the moving surface.

13. A method as in claim 1, further including the step of preventing lifting of the doctor roll support.

14. A method as in claim 4, further including the steps of pivoting the doctor roll support on a curved bar upstream of the doctor roll, pivoting the doctor roll support off a downstream portion of the curved bar upstream of the doctor roll at least particularly sealing the excess coating in the coater with the curved bar, applying the excess coating to the moving surface upstream of the doctor roll and doctor roll support and closely adjacent the curved bar, including the further steps of cooling the doctor roll support, curving the downstream end of the doctor roll support, pivoting and sliding the curved downstream end of the doctor roll support against the retaining member, rotating the doctor roll in a direction so that at the point of contact with coating on the moving surface the doctor roll moves in the opposite direction of the moving surface, and preventing lifting of the doctor roll support.

15. A method as in claim 5, further including the steps of:

pivoting the doctor roll support on a downstream end of a curved bar upstream of the doctor roll, cooling the doctor roll support, curving the downstream end of the doctor roll support, pivoting and sliding the curved downstream end of the doctor roll support against the retaining member, rotating the doctor roll in a direction so that at the point of contact with coating on the moving surface the doctor roll moves in the opposite direction of the moving surface, and preventing lifting of the doctor roll support.

* * * * *